US005429525A

United States Patent [19]

McCoy

[11] Patent Number: 5,429,525

[45] Date of Patent: Jul. 4, 1995

[54] CONNECTOR ASSEMBLY

[76] Inventor: Phillip A. McCoy, 5441 E. 300 S., LaOtto, Ind. 46763

[21] Appl. No.: 93,775

[22] Filed: Jul. 19, 1993

[51] Int. Cl.[6] ..... H01R 13/627

[52] U.S. Cl. ..... 439/352; 439/357

[58] Field of Search ..... 439/350, 351, 352, 353–358

[56] References Cited

U.S. PATENT DOCUMENTS

| | | | |
|---|---|---|---|
| 1,552,346 | 9/1925 | Riley | 439/358 |
| 1,559,361 | 10/1925 | Parker | 439/350 |
| 2,235,020 | 3/1941 | Jones | 439/358 |
| 3,399,374 | 8/1968 | Pauza et al. . | |
| 3,530,424 | 9/1970 | Gregory . | |
| 3,573,706 | 4/1971 | Haberlen . | |
| 3,651,446 | 3/1972 | Sadogierski et al. . | |
| 3,777,298 | 12/1973 | Newman | 439/350 |
| 4,012,097 | 3/1977 | Long et al. | 439/350 |
| 4,032,209 | 6/1977 | Rutkowski | 439/358 |
| 4,203,639 | 5/1980 | VandenHoek et al. . | |
| 4,373,765 | 2/1983 | Ritter . | |
| 4,429,934 | 2/1984 | VandenHoek et al. . | |
| 4,526,431 | 7/1985 | Kasukawa | 439/352 |
| 4,526,433 | 7/1985 | Tanaka . | |
| 4,695,112 | 9/1987 | Maston et al. | 439/350 |
| 4,781,612 | 11/1988 | Thrush | 439/325 |
| 4,850,891 | 7/1989 | Walkup et al. | 439/326 |
| 4,867,699 | 9/1989 | Oda et al. | 439/350 |
| 5,080,604 | 1/1992 | Rider et al. | 439/357 |
| 5,130,892 | 7/1992 | Satou | 439/352 |
| 5,158,473 | 10/1992 | Takahashi et al. | 439/353 |
| 5,160,275 | 11/1992 | Nakamura et al. | 434/328 |

*Primary Examiner*—Larry I. Schwartz
*Assistant Examiner*—Hien D. Vu
*Attorney, Agent, or Firm*—Barnes & Thornburg

[57] ABSTRACT

A connector assembly has a locking arrangement for locking electrical plug-in connectors together so as to prevent unintended disconnection. The locking arrangement includes a resilient, cantilevered, biased latch coupled to a first plug and one or more protrusions on an exterior surface of the second plug. The latch has one or more openings for receiving the one or more protrusions to secure the first and second plugs together. The latch may be integrally molded to the first plug. Structure may be provided for disengaging the latch. The disengaging structure extends through the second plug and, in a preferred embodiment, is a non-spring-loaded, two-piece assembly. However, the disengaging structure may also be a spring-loaded, two-piece assembly. When the two plugs are connected together, a portion of the latch extends over a portion of the exterior surface of the second plug so as to bias the disengaging structure in the direction of the bias of the latch, and so that the one or more protrusions are disposed through the one or more corresponding openings formed in the latch. The disengaging structure can be moved in a direction opposing the bias of the latch so as to disengage the openings formed in the latch from the one or more protrusions on the second plug so that the plugs can be disconnected.

55 Claims, 2 Drawing Sheets

CONNECTOR ASSEMBLY

BACKGROUND AND SUMMARY OF THE INVENTION

The present invention relates to connector assemblies and particularly to assemblies used to lock electrical plug-in connectors together so as to prevent unintended disconnection. More particularly, the present invention is directed to an electrical connector latch assembly for lockingly connecting first and second plug-in connectors together. The electrical connector latch assembly has a resilient, integrally molded, cantilevered, biased latch with one or more openings formed therein. The latch is molded in or otherwise coupled to the first plug-in connector. A movable button and one or more protrusions are respectively disposed through and formed on the second plug-in connector, the number of protrusions being in one-to-one correspondence with the number of openings formed in the latch.

Electrical connector locking assemblies using latches and push-button releases are well known in the art. For example, FIG. 3 of U.S. Pat. No. 4,526,433 to Tanaka shows an engaging piece 2' that is cantilevered to body 1 and has a locking hole 2a' formed therein. An engaging projecting piece 32 formed on part 3 has an engaging projection 32a formed thereon. Body 1 and part 3 are matingly connected together so that engaging projection 32a extends through locking hole 2a' so as to lock body 1 and part 3 together. The two are disconnected by removal of cap 5 and insertion of a tool or jig 4 (see FIG. 2) having a hook-shaped front end 4a through hole 1b formed in body 1 that raises engaging piece 2' upward so that engaging projection 32a no longer extends through hole 2a'. At least two characteristics of Tanaka are worth noting. The first relates to the complex shapes of piece 2 shown, for example, in FIGS. 3 and 6. Also, repeated use of hook-shaped front end 4a of tool or jig 4 may cause wear to and deformation of engaging piece 2 manifested by decreased resiliency thereof.

Another example is U.S. Pat. No. 3,399,374 to Pauza et al. that shows a block 50 that is disengageably secured to receptacle 2 by means of hasps 64 integrally molded on the sides of block 50. Hasps 64 extend from columns 66 and snap over the rearwardly facing side of inclined plane bosses 30. Each hasp 64 has an integral, rearwardly extending finger piece 68 which, when pressed, causes hasp 64 to be elevated above the surface of block 50 to permit disengagement with receptacle 2.

At least one problem with the Pauza et al. design is that hasps 64 may be torn off of block 50 due to repeated use or rough handling. This would primarily result from the pivotal mounting of hasp 64 to block 50 via column 66. As can be seen in FIG. 1, this mounting configuration provides only small surface area contact between column 66 and block 50.

Applicant makes no representation by this discussion, nor should any such representation be inferred, that an exhaustive search of all relevant prior art has been conducted, or that no more pertinent prior art exists.

An electrical plug-in connector assembly that solves the above problems would be a welcome improvement. Accordingly, an improved electrical connector assembly is provided for securing the connection of first and second plugs together. The subject assembly has a locking means for securing the first and second plugs together. The locking means includes a resilient latch coupled to the first plug and extending outwardly therefrom. When the first and second plugs are matingly engaged, the latch is elastically deformed by the second plug and is resiliently biased into contact therewith. At least one protrusion on an exterior surface of the second plug is also provided. The latch has means for receiving the protrusion on the exterior surface of the second plug to secure the first and second plugs together. In a preferred embodiment, the first plug comprises a molded body and the latch comprises a metal plate insert that is molded into a portion of the body of the first plug. The second plug body comprises a molded body and the at least one protrusion is integrally molded on the exterior surface of the second plug.

The connector latch assembly further has means for disengaging the locking means so that the first and second plugs matingly engaged can be disengaged. In a preferred embodiment, the disengaging means extends through the second plug. When the first and second plugs are connected together, the latch extends over a portion of the exterior surface of the second plug, so as to bias the disengaging structure of the second plug in the direction of bias of said latch. In a preferred embodiment, the latch has a recessed portion for receiving the disengaging means when the first and second plugs are connected together.

The disengaging means is movable in a direction opposite the bias of the latch so as to disengage the receiving means of the latch from the protrusion on the exterior surface of the second plug so that said first and second plugs can be disconnected.

The connector latch assembly further has a camming means for moving the latch against the direction of the bias thereof as the first and second plugs are connected together. This movement allows the protrusion on the exterior surface of the first plug to be received in the means for receiving the protrusion formed in the latch. In a preferred embodiment, the camming means is disposed on the protrusion on the exterior surface of the second plug and may be integrally molded therewith.

In a preferred embodiment, the disengaging means is a non-spring-loaded button. However, the disengaging means may also be spring-loaded. In the preferred embodiment, the button is made from plastic or an equivalent material. Such a button reduces destruction of the surfaces of the latch often caused when tools or jigs are used to move the latch against the direction of its bias. Also, because the direction of movement of the button is limited, possible damage to the bias of the latch caused by excessive bending thereof when tools or jigs are used is eliminated. The button may be a two-piece assembly where the first and second halves are substantially identical. Both the first and second halves have a first portion with a socket formed therein and a second portion coupled on one end to the first portion so as to extend substantially perpendicularly therefrom. A bulb is formed on the other end of the second portion.

The button is assembled by disposing the second portion of the first half through a first opening formed through the second plug and the second portion of the second half through a second opening formed through the second plug, so that the bulb formed on the second portion of the first half is received in the socket formed in the first portion of the second half and the bulb formed on the second portion of the second half is received in the socket formed in the first portion of the first half to connect the first and second halves together so that the button is formed. The first and second halves may be connected together by heat staking, ultrasonic welding, gluing, cementing, press-fitting, or equivalent means.

When the first and second plugs of the preferred embodiment having the button are connected together, a portion of the latch extends over a top surface of the first portion of the first half so as to move the button in the direction of the bias of the latch. The protrusions on the exterior surface of the second plug over which the latch extends are received in one or more openings formed in the latch. The first and second plugs can be disconnected by movement of the first portion of the second half of the button in the direction opposite the bias of the latch so that the top surface of the first portion of the first half of the button contacts the portion of the latch extending thereover. This movement disengages the openings formed in the latch over the protrusions on the second plug so that the first and second plugs can be disconnected.

It should be noted that the location of the locking means on the first plug and the disengaging means on the second plug are interchangeable. That is, the disengaging means could be located on the first plug and the locking means on the second plug. Such configuration is still within the scope and spirit of the present invention. Furthermore, the protrusions may be located on more than one exterior surface so that the locking means could extend over any of the exterior surfaces having the protrusions thereon. Having protrusions on more than one exterior surface allows the first and second plugs to be connected together in more than one orientation.

In one embodiment of the present invention, the first plug has two laterally spaced electrical sockets into which second and third plugs are received. In this embodiment, resilient, latches are coupled to the first plug and extending outwardly therefrom. When the second and third plugs are matingly coupled to the first plug, each of the latches are elastically deformed by a respective one of the second and third plugs and are resiliently biased into contact therewith. Each of the second and third plugs have at least one protrusion on an exterior surface thereof and each of the latches have means for receiving the protrusions on the exterior surfaces of the second and third plugs.

It should be noted that the various structural features and embodiments associated with the first and second plugs discussed above apply to the embodiment of the first, second, and third plugs. For example, the disengaging structure can be the two-piece button assembly discussed above. The only difference would be that two buttons are necessary, one for the second plug and one for the third plug.

Other objects, advantages and novel features of the present invention will become apparent from the following detailed description of the invention when considered in conjunction with the accompanying drawings.

DETAILED DESCRIPTION OF THE DRAWINGS

Figure 1:
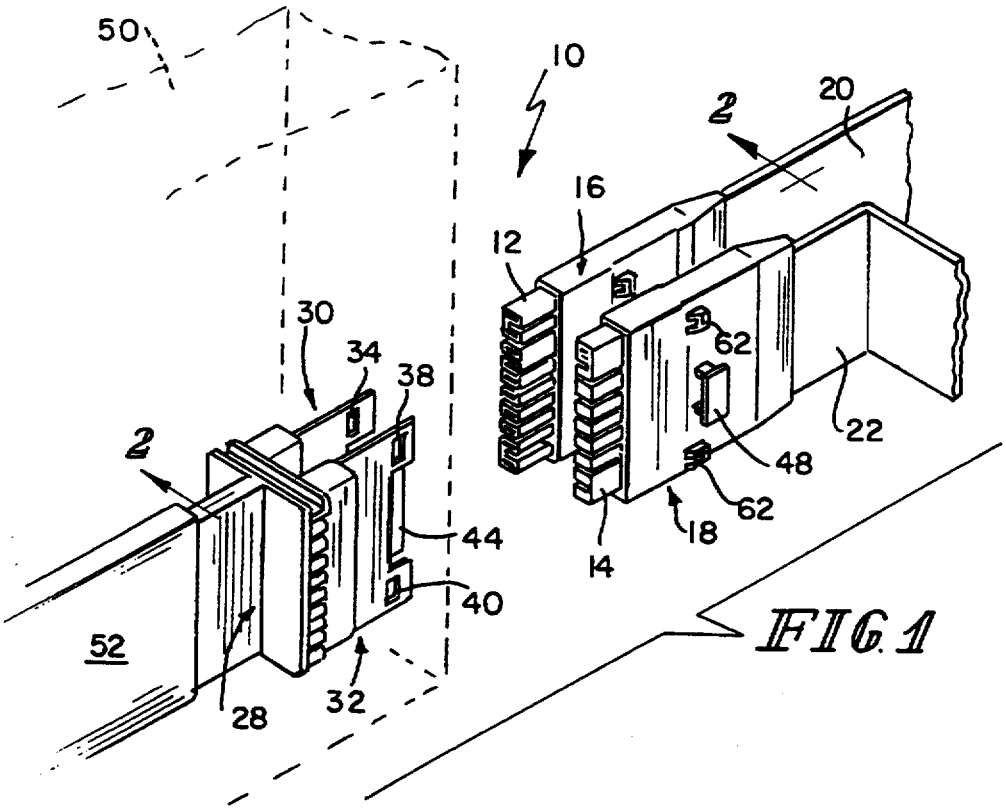
FIG. 1 is a perspective view of an electrical connector latch assembly constructed in accordance with the present invention.

A preferred embodiment of the electrical connector latch assembly 10 of the present invention is shown in FIG. 1. Connector latch assembly 10 is used to lock plugs 12 and 14 of male connectors 16 and 18, both of which are attached to separate flexible festoon connectors 20 and 22 in openings 24 and 26 (see FIGS. 2 and 3) of female connector 28. While a single C-shaped female connector 28 is shown, it should be understood that two separate female connectors may be used within the scope and spirit of the present invention. As can best be seen in FIG. 2, plugs 12 and openings 24 are "keyed" as is known in the art. That is, male connector 16 and female connector 28 can only be connected in a predetermined orientation due to the number and shapes of plugs 14 vis-à-vis openings 24. It should be noted that, although not shown, plugs 14 and openings 26 (see FIG. 3) for respective male and female connectors 18 and 28 may be similarly keyed.

FIG. 1 also shows the resilient latches 30 and 32 of the present invention. Latch 30 has openings 34 and 36 (shown in FIG. 2) formed therethrough and latch 32 has openings 38 and 40 formed therethrough, the function of which will be described below. Latches 30 and 32 also have recessed portions 42 and 44 (see FIG. 1) that receive a portion of button assemblies 46 (see FIG. 2) and 48.

As can be seen from FIG. 1, the electrical connector latch assembly 10 of the present invention can be used with modular wall 50 power distribution systems 52 that are used in dividing a given area into separate work spaces. Other possible applications include use in "raised floor" settings such as are common in laboratories.

Figure 2:
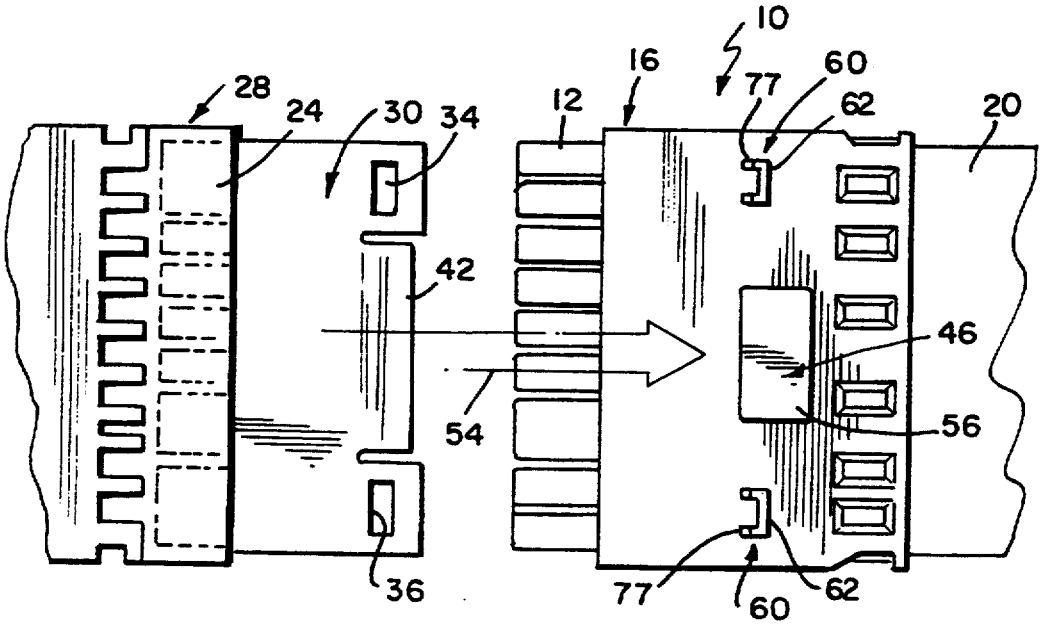
FIG. 2 is a slide elevational view taken along line 2—2 of FIG. 1.

FIG. 2 is a side elevational view of the electrical connector latch assembly 10 taken along line 2—2 of FIG. 1. A portion of female connector 28 is shown prior to insertion in male connector 16. This is generally indicated by arrow 54. As discussed above, the "keying" of plugs 12 and openings 24 can be seen in that plugs 12 can only be inserted into openings 24 in the orientation depicted by FIG. 2.

Latch 30 is shown in FIG. 2, as are openings 34 and 36 formed therein. Recessed portion 42 is also shown in FIG. 2. When male and female connectors 16 and 28 are connected together, recessed portion 42 rides over the top 56 of button assembly 46 forcing button assembly 46 through connector 16 in the direction of the bias of latch 30 as will be discussed with reference to FIG. 4 below. In a similar manner, recessed portion 44 rides over top 58 (see FIGS. 3 and 4) of button assembly 48.

Figure 4:
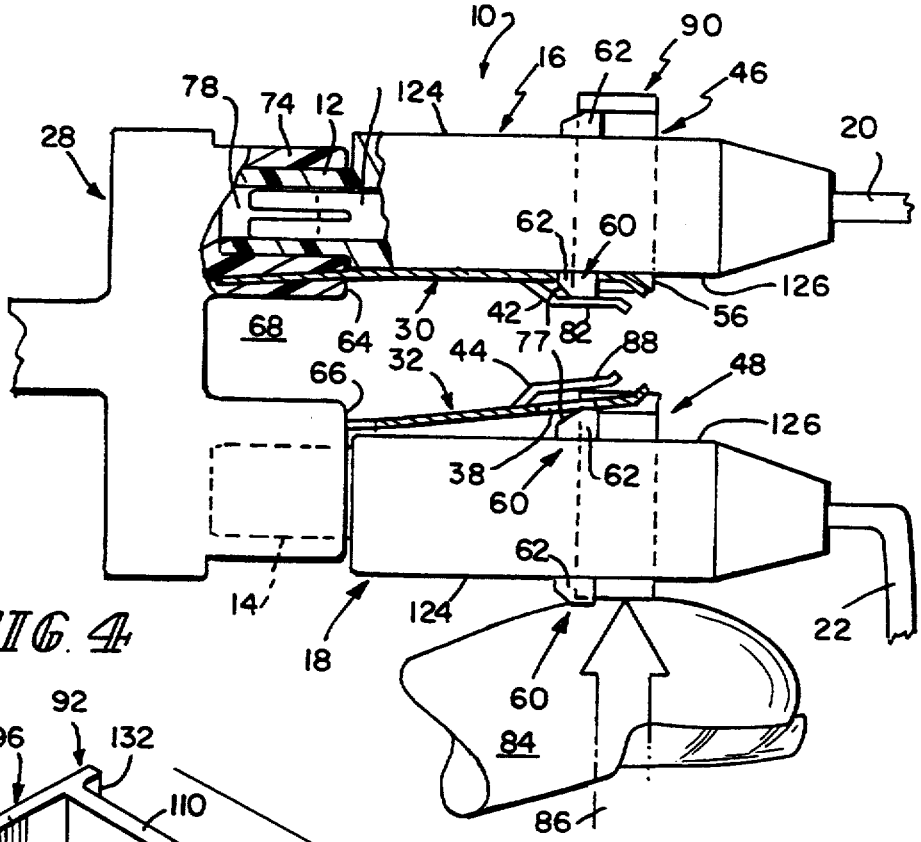
FIG. 4 is a top view of the electrical connector latch assembly constructed in accordance with the present invention with portions brown away showing the manual operation of the button assembly.

Locking structure 60 is also shown in FIG. 2. Locking structure 60 includes protrusions 62, the number of which is in one-to-one correspondence with the number of openings formed in latch 30. Corresponding locking structure 60 and protrusions 62 are formed on male connector 18 as shown in FIG. 4 which is discussed in more detail below.

Figure 3:
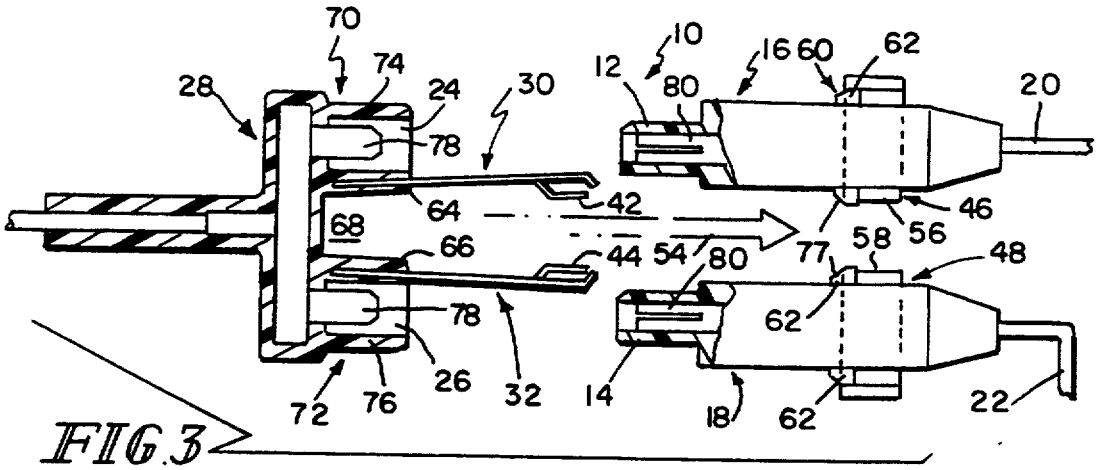
FIG. 3 is a top view of the electrical connector latch assembly constructed in accordance with the present invention, prior to connection, showing portions broken away.

As can be appreciated with reference to FIGS. 2 and 3, latches 30 and 32 are substantially flat, resilient rectangularly-shaped pieces of metal or equivalent material. The generally flat shape of latches 30 and 32 makes them easier to form than some of the other conventionally used engaging structure shapes such as hooks. This ease of forming saves both in time and expense. The cantilevered mounting of latches 30 and 32 is also shown in FIGS. 2 and 3. Latches 30 and 32 are connected to respective end portions 64 and 66 of female connector 28. In the preferred embodiment shown in the drawings, latches 30 and 32 are integrally molded to respective end portions 64 and 66. Integral molding has at least two advantages. The first is that separate structure attaching latches 30 and 32 to female connector 28 is unnecessary. Secondly, integral molding of latches 30 and 32 to respective end portions 64 and 66 provides a secure connection that may not be possible with other types of connection such as gluing or cementing.

As can be seen in FIG. 3, latches 30 and 32 are disposed adjacent the interior region 68 of female connector 28 rather than general exterior locations 70 and 72. Location adjacent interior region 68 helps both protect latches 30 and 32 from physical damage by allowing outside portions such as walls 74 and 76 to absorb physical shocks. Location adjacent interior region 68 also helps reduce the overall size of the combined female connector 28 and electrical connector latch assembly 10 by utilizing the otherwise empty space adjacent interior region 68.

Also shown in FIG. 3 is the outward bias of latches 30 and 32. This outward bias is used to move button assemblies 46 and 48 through male connectors 16 and 18 as will be discussed with reference to FIG. 4 below. A camming structure 77 can also be seen in FIGS. 2 and 3. Camming structure 77 is designed to lift latches 30 and 32 over protrusions 62 when female connector 28 is moved in the direction of arrow 54 towards male connectors 16 and 18. This lifting is done so that protrusions 62 will be disposed in openings 34, 36, 38, and 40 of latches 30 and 32 to securely lock connectors 16, 18, and 28 together. This secure engagement ensures that electrical and physical contact between male prongs 78 of female connector 28 and female clips 80 of male connectors 16 and 18 will not be unintentionally broken.

FIG. 4 shows male connector 16 and female connector 28 secured together via electrical connector latch assembly 10. FIG. 4 also shows the manual operation of button assembly 48 used to lift latch 32 over protrusions 62. As can be seen, male prongs 78 and female clips 80 of respective connectors 28 and 16 are connected together via secure engagement of latch 30 with locking structure 60. Latch 30 is shown with protrusions 62 disposed in openings 34 and 36 (see FIG. 2) and a portion of flat area 82 of recessed portion 42 extending over top 56 of button assembly 46.

The configuration of electrical connector assembly 10 is relatively stronger than some conventional designs. As can be seen from FIG. 4, latch 30 lies in a generally straight orientation. A force acting in a direction opposite of arrow 54 to separate male connector 16 and female connector 28 would thus be generally directed along the length of substantially flat latch 30. This force would act at end portion 64 (the point of connection of latch 30 to connector 28) and at the location of locking structure 60 (where protrusions 62 are disposed in openings 34 and 36). This means that latch 30 can be made of thinner material than that used in designs where at least a portion of the forces experienced by the engaging structure are generally directed transverse the length thereof. The use of thinner material in the depicted embodiments of electrical connector latch assembly 10 has at least the advantages of being easier to form and less expensive.

FIG. 4 also shows the disengaging structure 90 of the present invention that includes button assemblies 46 and 48. In a preferred embodiment, button assemblies 46 and 48 are generally free to move in connectors 16 and 18. That is, button assemblies 46 and 48 are not spring-loaded. It should be noted, however, that button assemblies 46 and 48 may also be spring-loaded. Button assembly 46 is shown disposed in connector 16 as a result of the influence of the bias of latch 30 acting thereon. That is, button assembly 46 has moved through connector 16 in the direction of bias of latch 30 to the fullest extent possible. A force greater than and in the opposite direction of the resultant bias force of latch 30 is necessary to move button assembly 46 so as to unlatch protrusions 62 from openings 34 and 36.

Button assembly 48 is shown being manually moved by digit 84 in the direction of arrow 86. This movement forces top 58 against the interior of flat area 88 of latch 32 so as to unlatch protrusions 62 from openings 38 and 40 (shown in FIG. 1). This allows connectors 18 and 28 to be separated. As discussed above, digit 84 is exerting a force in the direction of arrow 86 greater than and opposite to the resultant bias force of latch 32.

Button assemblies 46 and 48 prevent the need for the use of a tool or jig to move latches 30 and 32 against the direction of the biases thereof so that connectors 16, 18, and 28 may be separated. Button assemblies 46 and 48 are also made from plastic or an equivalent material. The use of button assemblies 46 and 48 thus prevents possible destruction of the surfaces of latches 30 and 32 caused by contact by tools and jigs. Because button assemblies 46 and 48 can only travel so far, they also prevent possible damage to the biases of latches 30 and 32 resulting from excessive bending thereof when tools and jigs are used. It should be noted, however, that while the use of button assemblies 46 and 48 is preferred, tools such as screwdrivers, pliers, etc. or jigs may be used in some embodiments of the invention to move latches 30 and 32 against the direction of the biases thereof in order to separate connectors 16 and 18 from connector 28.

FIG. 4 shows protrusions formed on both sides 124 and 126 of male connector 18. This allows latch 32 to engage locking structure 60 on either of sides 124 and 126, not just side 126 as shown in FIG. 4. Because latch 32 can be connected to either side 124 or 126, the openings 26 of female connector 28 are "unkeyed" or "keyed" so that male connector 18 can be inserted so that latch 32 engages locking structure 60 on either sides 124 or 126 thereof.

Figure 5:
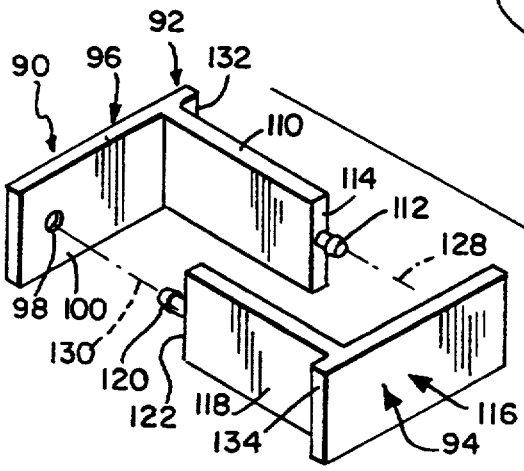
FIG. 5 is a perspective view of the disengaging structure constructed in accordance with the present invention.

FIG. 5 shows a perspective view of the disengaging structure 90 of the present invention. Disengaging structure 90 includes a first half portion 92 and a second half portion 94. First and second half portions 92 and 94 are constructed so as to be substantially identical in size and shape. First half portion 92 includes a first portion (or part/end) 96 having an opening 98 formed in an interior surface 100 thereof. First half portion 92 also includes a second portion 110 extending substantially perpendicular to first piece 96 having a bulb 112 formed on an end or part 114 thereof. Second half portion 94 includes a first portion 116 having an opening (not shown) formed in an interior surface (also not shown) thereof. Second half portion 94 also includes a second portion or part 118 extending generally perpendicular to first portion 116 having a bulb 120 formed on an end or part 122 thereof.

Disengaging structure 90 is assembled by first disposing the second portion 110 of first half portion 92 in either of first slots (not shown) formed through both male connectors 16 or 18 and disposing the second portion 118 of second half portion 94 in either of second slots formed through both of the male connectors 16 or 18. It should be noted that second portions 110 and 118 of respective first and second half portions 92 and 94 need to be disposed in respective first and second slots so that first portions 96 and 116 are on opposite sides 124 and 126 (see FIG. 4) of male connectors 16 and 18. Next, bulb 112 on end 114 of second portion 110 is inserted into the opening (not shown) formed in first portion 116 of second half portion 94 and bulb 120 on end 122 of second portion 118 is inserted into opening 98 formed in first portion 96. Bulbs 112 and 120 are then securely disposed within the openings of first portions 96 and 116 via heat staking, ultrasonic welding, gluing, cementing, press-fitting or other equivalent means. Lines 128 and 130 appearing in FIG. 5 are intended to show the disposition of bulbs 112 and 120 within the openings formed in first portions 96 and 116 of first and second halves 92 and 94.

Shoulders 132 and 134 are respectively shown on first and second half portions 92 and 94. At least one intended function of shoulders 132 and 134 is to prevent dirt, moisture, and other contaminants from entering the first and second slots formed through male connectors 16 and 18 that receive the second portions 110 and 118 of first and second halves 92 and 94.

From the preceding description of the preferred embodiments, it is evident that the objects of the invention are attained. Although the invention has been described and illustrated in detail, it is to be clearly understood that the same is intended by way of illustration and example only and is not to be taken by way of limitation. The spirit and scope of the invention are to be limited only by the terms of the appended claims.

What is claimed is:

1. An electrical connector assembly, comprising:

a first plug;

a second plug adapted to couple with the first plug along an axis, the second plug having a body that includes first and second opposing walls;

at least one protrusion on one of the walls of the second plug;

a resilient latch coupled to the first plug and extending outwardly therefrom such that, when said plugs are coupled together, said latch is elastically deformed by the protrusion and is resiliently biased into engagement therewith to secure said plugs together; and a button assembly, including a first half portion and a second half portion which engage each other to form a substantially rectangular shape, extending transversely through the first and second walls of the second plug, said button assembly cooperating with said resilient latch and being biased by said latch in a direction transverse to the axis along which the plugs are coupled, said button assembly being operable to disengage the latch from the protrusion so that the plugs can be separated by a force directed generally along the axis and generally transverse to the force used to operate the button assembly.

2. The connector assembly of claim 1, wherein the first plug comprises a molded body, and wherein said latch comprises a metal plate insert molded into a portion of the body of the first plug.

3. The connector assembly of claim 1, wherein the second plug comprises a molded body, and wherein the at least one protrusion is integrally molded on the body of the second plug.

4. The connector assembly of claim 1, wherein a portion of the latch extends over a portion of an exterior surface of the second plug when the first and second plugs are coupled together so as to bias the button assembly in a direction of bias of said latch.

5. The connector assembly of claim 4, wherein the latch has a recessed portion adjacent the button assembly.

6. The connector assembly of claim 1, further comprising camming means for moving the latch against a direction of bias thereof as the first and second plugs are coupled so that the protrusion on the second plug is received in an opening formed in said latch.

7. The connector assembly of claim 6, wherein the camming means is on the protrusion of the second plug.

8. The connector assembly of claim 7, wherein the camming means is integrally molded with the protrusion.

9. The connector assembly of claim 1, wherein the button assembly is non-spring-loaded.

10. The connector assembly of claim 1, wherein the first and second half portions are substantially identical.

11. The connector assembly of claim 1, wherein a first part of the first half portion of the button assembly lies adjacent the first wall of the second plug, a second part of the first half portion extends through first openings formed in the first and second opposing walls of said second plug, a fast of the second half portion of said button lies adjacent the second wall of the second plug, and a second part of the second half portion extends through second openings formed in the first and second opposing walls of said second plug, and further wherein said first and second half portions are coupled together.

12. An electrical connector assembly, comprising:

first and second mating electrical plugs each having a body that includes first and second opposing walls;

a latch assembly for securing the first and second plugs when coupled together in an axial direction; and means extending through and connected between the first and second opposing walls of the second plug for disengaging said latch assembly by the application of a first force directed transverse to the axial direction so that the first and second plugs can be uncoupled by the application of a second force directed along the axial direction;

wherein the disengaging means is a button assembly, including a first half portion and a second half portion which engage each other to form a substantially rectangular shape; and wherein said first and second half portions are substantially identical.

13. The electrical connector assembly of claim 12, wherein said latch assembly comprises a cantilevered, biased latch coupled to the first plug and at least one protrusion on an exterior surface of the second plug, said latch engaging the protrusion to lock said first and second plugs together.

14. The electrical connector assembly of claim 13, wherein the latch comprises a substantially flat piece of metal.

15. The electrical connector assembly of claim 13, wherein the latch is insert molded to the first plug.

16. The electrical connector assembly of claim 13, wherein the first plug is integrally molded around the latch.

17. The electrical connector assembly of claim 13, further including camming means for moving the latch against the direction of bias thereof so that the protrusion on the exterior surface of the second plug is received in an opening formed in said latch.

18. The electrical connector assembly of claim 17, wherein the camming means is formed on the protrusion.

19. The electrical connector assembly of claim 18, wherein the camming means is integrally molded with the protrusion.

20. The electrical connector assembly of claim 13, wherein the latch is a substantially flat plate having a recessed portion for adjacent the disengaging means.

21. The electrical connector assembly of claim 12, wherein the button assembly is non-spring-loaded.

22. The electrical connector assembly of claim 12, wherein the first and second half portions each have a first part with a socket formed therein and a second part coupled on one end to the first part so as to extend substantially perpendicularly therefrom and having a bulb formed on the other end thereof.

23. The electrical connector assembly of claim 22, wherein the second part of the first half portion extends through first openings formed in the first and second opposing walls of the second plug and the second portion part of the second half portion extends through second openings formed in the first and second opposing walls of said second plug so that the bulb formed on the second part of the first half portion is received in the socket formed in the first part of the second half portion and the bulb formed on the second part of said second half portion is received in the socket of the first part of said first half portion to connect the first and second half portions together to form the button assembly.

24. The electrical connector assembly of claim 23, wherein the first and second half portions of the button assembly are connected together by one of heat staking, ultrasonic welding, gluing, cementing, and press-fitting.

25. The electrical connector assembly of claim 23, wherein a portion of the latch extends over a top surface of the first portion of the first half portion when the first and second plugs are connected together so as to move the button assembly in a direction of bias of said latch, and the protrusion on the exterior surface of said second plug over which said latch extends is received in an opening formed in the latch.

26. The electrical connector assembly of claim 25, wherein the first part of the second half portion of the button assembly is movable in a direction opposite the bias of the latch so that the top surface of the first part of the first half portion of said button assembly contacts a flat area of a recessed portion of said latch so as to disengage the opening formed in the latch from the protrusion on the second plug so that said first and second plugs can be uncoupled.

27. An electrical connector assembly, comprising:

a first plug having two laterally spaced plug-in electrical sockets;

second and third plugs receivable in said sockets along an axis, the second and third plugs each having a body that includes a pair of first and second opposing walls;

at least one protrusion on one of the walls of each of the second and third plugs;

a pair of resilient latches coupled to the first plug and extending outwardly therefrom such that, when said second and third plugs are coupled to the first plug, said latches are elastically deformed by the protrusions on the second and third plugs and are each resiliently biased into engagement with one of the protrusions to secure said second and third plugs to the first plug; and a button assembly including first and second half portions which engage each other to form a substantially rectangular shape, and extending transversely through the opposing first and second walls of each of the second and third plugs, each of said button assembly cooperating with a different one of the resilient latches so that the button assembly is biased in a direction transverse to the axis along which the plugs are coupled, said button assembly being operable to disengage the latch from the protrusion so that the plug to which the button assembly is coupled can be separated from the first plug by a force directed generally along the axis and generally transverse to the force used to operate the button assembly.

28. The electrical connector assembly of claim 27, wherein each of the latches is formed from a substantially flat piece of metal.

29. The electrical connector assembly of claim 27, wherein the first plug has a molded body, and wherein the latches are insert molded with said body adjacent an interior region of the body that is located between the electrical sockets.

30. The electrical connector assembly of claim 27, wherein each latch includes one or more openings and the number of protrusions on the second and third plugs is in one-to-one correspondence with the number of openings formed in the latches of the first plug.

31. The electrical connector assembly of claim 30, wherein the second and third plugs have molded bodies, and the protrusions are integrally molded on exterior surfaces of the second and third plugs.

32. The electrical connector assembly of claim 31, further comprising camming means formed on each of the protrusions.

33. The electrical connector assembly of claim 32, wherein the camming means are integrally molded with each of the protrusions.

34. The electrical connector assembly of claim 27, wherein the latches are substantially flat and generally rectangularly shaped, and are configured to include recessed portions adjacent the button assemblies.

35. The electrical connector assembly of claim 34, wherein the recessed portions of each of the latches is flanked on either side by an opening for receiving one of the protrusions.

36. The electrical connector assembly of claim 27, wherein the button assemblies are non-spring-loaded.

37. The electrical connector assembly of claim 27, wherein said first and second half portions are of substantially identical shape, said first and second portions each having a first part with a socket formed therein and a second part extending substantially perpendicularly from one end of the first part, said second part having a bulb formed on a distal end thereof.

38. The electrical connector assembly of claim 37, wherein the first and second parts of each of the first and second half portions are integrally formed.

39. The electrical connector assembly of claim 37, wherein the second parts of each of the first half portions extend through first openings formed in the first and second opposing walls of each of the second and third plugs and the second parts of each of the second half portions extend through second openings formed in the first and second opposing walls of the second and third plugs so that the bulbs formed on distal ends of the second parts of the two first half portions are each received in a different one of the sockets of the first parts of the two second half portions and the bulbs formed on the ends of the second parts of the two second half portions are each received in a different one of the sockets of the first parts of the two first half portions to securely connect the first and second half portions together to form one button assembly on each of said second and third plugs.

40. The electrical connector assembly of claim 39, wherein a portion of each of the latches extends over a top surface of each of the first parts of the first half portions when the first, second, and third plugs are coupled so as to bias the two button assemblies through the second and third plugs in directions of bias of said latches, and wherein the protrusions on the second and third plugs are received in openings formed in the latches.

41. The electrical connector assembly of claim 40, wherein the two button assemblies are movable in directions opposite the biases of the latches so that the top surfaces of the first parts of the first half portions of the two button assemblies contact different flat areas of recessed portions of each of said latches so as to disengage the openings formed therethrough from said protrusions so that said first, second, and third plugs can be uncoupled.

42. The electrical connector assembly of claim 39, wherein the first and second half portions of each of the two button assemblies are connected together by one of heat staking, ultrasonic welding, gluing, cementing, and press-fitting.

43. An electrical connector assembly, comprising:

first and second mating electrical plugs;

a cantilevered, biased latch coupled to the first plug, said latch having retaining means for receiving at least one protrusion on an exterior surface of the second plug to lock said first and second plugs together; and means for disengaging said latch, the disengaging means extending through walls of said second plug and including a button assembly, the button assembly having a first half portion and a second half portion;

wherein each of the first and second half portions has a first end with a socket formed therein and a second end with a bulb formed thereon, said first and second half portions engaging each other to form a substantially rectangular shape.

44. The electrical connector assembly of claim 43, wherein the second end of the first half portion extends through a first opening formed through the second plug and the second end of the second half portion extends through a second opening formed through said second plug so that the bulb formed on the second end of the first half portion is received in the socket formed in the first end of the second half portion and the bulb formed on the second end of said second half portion is received in the socket of the first end of said first half portion to connect the first and second half portions together to form the button assembly.

45. The electrical connector assembly of claim 44, wherein the first and second half portions of the button assembly are connected together by one of heat staking, ultrasonic welding, gluing, cementing, and press-fitting.

46. The electrical connector assembly of claim 44, wherein a portion of the latch extends over a top surface of the first end of the first half portion when the first and second plugs are connected together so as to move the button assembly in the direction of bias of said latch, and the one or more protrusions on the exterior surface of said second plug over which said latch extends are received in one or more corresponding openings formed in the latch.

47. The electrical connector assembly of claim 46, wherein the first end of the second half portion of the button assembly is movable in a direction opposite the bias of the latch so that the top surface of the first end of the first half portion of said button assembly contacts a flat area of a recessed portion of said latch so as to disengage the openings formed in the latch over the one or more protrusions on the second plug so that said first and second plugs can be disconnected.

48. An electrical connector assembly, comprising:

a first plug having two laterally spaced plug-in electrical sockets;

second and third plugs receivable in said sockets;

a pair of resilient latches coupled to the first plug and extending outwardly therefrom, each of said second and third plugs having at least one protrusion on an exterior surface thereof, such that, when said second and third plugs are matingly engaged in the sockets, each of said latches is elastically deformed by a respective one of said protrusions and is resiliently biased into contact therewith, and each of said latches having retaining means for cooperating with said protrusions to secure said second and third plugs to the electrical sockets;

said second and third plugs each having means extending through corresponding walls for disengaging said latches from said plugs, the disengaging means including a pair of button assemblies, each of said button assemblies including a first half portion and a second half portion which engage to form a substantially rectangular shape; and wherein the latches are substantially flat and generally rectangularly shaped, and have recessed portions for receiving the disengaging means.

49. The electrical connector assembly of claim 48, wherein the button assemblies are non-spring-loaded.

50. The electrical connector assembly of claim 48, wherein said first half portion and said second half portion substantially identical shapes, said first and second half portions each having a first end with a socket formed therein and a second end having a bulb formed thereon.

51. The electrical connector assembly of claim 50, wherein the first and second ends of each of the first and second half portions are integrally formed.

52. The electrical connector assembly of claim 50, wherein the second ends of each of the first half portions extend through first openings formed in each of the second and third plugs and the second ends of each of the second half portions extend through second openings formed through the second and third plugs so that the bulbs formed on the second ends of the first half portions are each received in a different one of the sockets of the first ends of the second half portion add the bulbs formed on the second ends of the second half portions are each received in a different one of the sockets of the first ends of the first half portions to securely connect the first and second half portions together to form a button assembly on each of said second and third plugs.

53. The electrical connector assembly of claim 52, wherein a portion of the latches extend over a top surface of each of the first ends of the first half portions when the first, second, and third plugs are connected together, so as to bias the two button assemblies outwardly through the second and third plugs in directions of bias of said latches, and the one or more protrusions on the exterior surfaces of said second and third plugs over which said latches extend are received in the openings formed in the latches.

54. The electrical connector assembly of claim 53, wherein the two button assemblies are movable in directions opposite the biases of the latches so that the top surfaces of the first ends of the first half portions of the two button assemblies contact different flat areas of recessed portions of each of said latches so as to disengage the openings formed therethrough from said protrusions so that said first, second, and third plugs can be disconnected.

55. The electrical connector assembly of claim 52, wherein the first and second half portions of each of the two button assemblies are connected together by one of heat staking, ultrasonic welding, gluing, cementing, and press-fitting.

* * * * *